US008305167B2

(12) United States Patent
Chida et al.

(10) Patent No.: US 8,305,167 B2
(45) Date of Patent: Nov. 6, 2012

(54) ELECTROMAGNETIC RELAY

(75) Inventors: Yoshifumi Chida, Sendai (JP); Kei Chiba, Sendai (JP)

(73) Assignee: NEC Tokin Corporation, Miyagi (JP)

( * ) Notice: Subject to any disclaimer, the term of this patent is extended or adjusted under 35 U.S.C. 154(b) by 0 days.

(21) Appl. No.: 12/992,497

(22) PCT Filed: May 12, 2009

(86) PCT No.: PCT/JP2009/058812

§ 371 (c)(1),
(2), (4) Date: Jan. 28, 2011

(87) PCT Pub. No.: WO2009/139367

PCT Pub. Date: Nov. 19, 2009

(65) Prior Publication Data

US 2011/0109410 A1 May 12, 2011

(30) Foreign Application Priority Data

May 12, 2008 (JP) ..... 2008-124640

(51) Int. Cl.
*H01H 67/02* (2006.01)

(52) U.S. Cl. ..... 335/119; 335/78

(58) Field of Classification Search ..... 335/119
See application file for complete search history.

(56) References Cited

U.S. PATENT DOCUMENTS

| | | | | |
|---|---|---|---|---|
| 5,587,693 | A * | 12/1996 | Fear | 335/78 |
| 5,781,089 | A * | 7/1998 | Doneghue | 335/78 |
| 5,929,730 | A * | 7/1999 | Hendel | 335/78 |
| 6,337,614 | B1 | 1/2002 | Tsutsui | |
| 6,414,576 | B1 | 7/2002 | Nakamura et al. | |
| 2003/0034863 | A1 | 2/2003 | Ono et al. | |

FOREIGN PATENT DOCUMENTS

| | | | |
|---|---|---|---|
| JP | 402012728 | * | 1/1990 |
| JP | 2000-315448 | A | 11/2000 |
| JP | 2001-185015 | A | 7/2001 |
| JP | 2002-216605 | A | 8/2002 |
| JP | 2003-059383 | A | 2/2003 |
| JP | 2004-127581 | A | 4/2004 |

* cited by examiner

*Primary Examiner* — Elvin G Enad
*Assistant Examiner* — Lisa Homza
(74) *Attorney, Agent, or Firm* — Sughrue Mion, PLLC

(57) ABSTRACT

To provide a twin-type power electromagnetic relay having high reliability, having a reduced size and low mounting height, and suitable for surface mounting.

By inserting projections provided in a coil spool, which is a component constituting an electromagnetic relay block, into projection insertion holes 5*a* and 5*b* formed in a base plate 5, two electromagnetic relay blocks 4A and 4B are arranged side by side on the base plate 5 such that their central axes are nearly parallel to the base plate. A base protective wall 5*c* is provided on the base plate 5, and a coil wire winding terminal portion of a spool is covered by the base protective wall and by a fixed terminal protective wall on the fixed terminal block when assembled, preventing foreign matters such as flux from entering between the contacts from the winding terminal portion.

6 Claims, 4 Drawing Sheets

ELECTROMAGNETIC RELAY

TECHNICAL FIELD

The present invention relates to an electromagnetic relay and, more particularly, to an electromagnetic relay having a plurality of unit electromagnetic relay blocks in one casing.

BACKGROUND ART

An electromagnetic relay, which is one of components for opening/closing an electric contact, is used for, e.g., forward/reverse rotation control of a motor or solenoid. A twin-type electromagnetic relay in which two unit electromagnetic relay blocks are arranged has been proposed (e.g., refer to Patent Documents 1 and 2). Such an electromagnetic relay is adopted in an automobile, etc., as an electric component and, with the demands for high-density packaging of automobile components, an electromagnetic relay having high reliability, a reduced size, and a low mounting height or an electromagnetic relay having high reliability, a reduced size and mounting height, and capable of surface mounting is required.

Patent Document 1: JP-A-2000-315448

Patent Document 2: JP-A-2003-059383

DISCLOSURE OF THE INVENTION

Problems to be Solved by the Invention

In a conventional twin-type, the center axis of a coil constituting an electromagnetic block extends perpendicular with respect to the board surface. In so-called a power electromagnetic relay for automobile use and the like that controls comparatively high power, the sizes of a yoke and an armature constituting the electromagnetic block are accordingly increased, so that the coil needs to generate sufficient attractive force and, accordingly, the coil needs to have a sufficient length. In the conventional configuration, the length of the coil is thus increased, preventing realization of an electromagnetic relay having a reduced size and height.

Further, in an electromagnetic relay disclosed in Patent Document 2, a terminal projects from the center of the lower surface of a base block and other terminals extend from all four side surfaces of a cover. Such a configuration requires bending work of the terminals for connection to external wirings, which is indispensable for surface mounting.

Incorporation of foreign matters at manufacturing time and occurrence of foreign matter during use may deteriorate reliability of the electromagnetic relay, and thus they must be completely avoided. What is further required is to eliminate foreign matters occurring when a metal member is inserted into a synthetic resin material at assembly time as well as to prevent foreign matters from occurring from a gate portion formed at the time of molding a synthetic resin, and further to prevent foreign matters, if occurring after assembly, from being introduced a contact portion where the introduced foreign matters adversely affect the operation of the electromagnetic relay.

Further, what is required, in the case of a surface-mount type electromagnetic relay, are ensuring of reliability of soldering connection between the electromagnetic relay and a substrate on which the electromagnetic relay is mounted and a structure capable of enduring thermal stress generated at the time of reflow soldering.

An object of the present invention is to provide an electromagnetic relay having high reliability, having a reduced size and low mounting height, and provided with a plurality of electromagnetic relay blocks suitable for surface mounting.

Means for Solving the Problems

According to an aspect of the present invention, there is provided an electromagnetic relay having, on a base plate, a plurality of electromagnetic relay blocks each provided with a movable contact swung by excitation current, a normally open contact and a normally closed contact which are arranged opposite to each other in the swinging direction of the movable contact across the movable contact, and fixed contacts, the normally open contact and movable contact being closed by the excitation current and the normally closed contact and movable contact being closed when the application of the excitation current is stopped. The electromagnetic relay blocks each have an electromagnetic block and a fixed terminal block, the electromagnetic block including a coil assembly and a movable contact block. The coil assembly has a coil block in which a coil wire is wounded around a spool having a coil terminal, a yoke formed into substantially an L-shape having one surface extending in the perpendicular direction with respect to the coil winding shaft of the coil block and the other surface extending in parallel thereto, and a core penetrating the coil block and having one end coupled to the yoke. The movable contact block has the movable contact spring having one end coupled to the yoke, an armature coupled to the movable contact spring, and a movable contact terminal having an external terminal portion for connection to an external wiring. The fixed terminal block is obtained by integrally molding, using a synthetic resin, a make-side fixed terminal for retaining a make-side fixed contact constituting the normally open contact and a break-side fixed terminal for retaining a break-side fixed contact constituting the normally closed contact. The fixed terminal block further has a fitting hole to which one end portion of the yoke is fitted. The make-side fixed terminal and break-side fixed terminal each have an external terminal portion for connection to an external wiring. At least one projection provided in the spool of the coil assembly constituting each of the electromagnetic relay blocks is inserted into a projection insertion hole formed in the base plate so as to fix each of the electromagnetic relay blocks.

In the electromagnetic relay, the make-side fixed terminal and break-side fixed terminal are formed by bending a metal plate having a notch, and the make-side fixed terminal and break-side fixed terminal are formed by bending an integrally formed metal plate extending in one plane.

In the electromagnetic relay, the make-side fixed contact retained by the make-side fixed terminal has a greater height than the break-side fixed contact retained by the break-side fixed terminal in terms of the direction projecting toward the movable contact side.

In the electromagnetic relay, the external terminal portions of the make-side fixed terminal, break-side fixed terminal and movable contact terminal each have substantially a bifurcated configuration, and leading end portions of each of the external terminal portions project from the base plate.

In the electromagnetic relay, the coil block has a winding terminal portion around which the coil wire is wound, and the winding terminal portion is surrounded by a protective wall provided under the two fixed contacts of the fixed terminal block and another protective wall provided on the base plate.

In the electromagnetic relay, the cover has a lib inside thereof, and the leading end portion of the lib is inserted into a lib insertion hole formed in the base plate for fixation.

Advantages Of The Invention

The electromagnetic relay according to the present invention is configured as follows: the two electromagnetic relay blocks are arranged side by side on the base plate each such that the central axes of the two fixed contacts, which are arranged opposite to each other in the swinging direction of the movable contact across the movable contact, substantially coincide with each other and that the coincident central axis is substantially parallel to the base plate; and the projections provided in the spool are inserted into the projection insertion holes formed in the base plate for thermocompression. With the above configuration, it is possible to reduce the mounting height while maintaining the function of a conventional twin-type electromagnetic relay, thereby realizing an electromagnetic relay capable of surface mounting.

Further, the end surface of the projection of the spool inserted into the projection insertion hole formed in the base plate is used as the gate portion at the time of molding of the spool, so that the gate portion where foreign matters are likely to occur is positioned at the outside surface of the electromagnetic relay body. Therefore, by thermocompressing the projection, it is possible to prevent introduction of foreign matters into the inside of the electromagnetic relay from the gate portion, thereby achieving high reliability.

Further, by using the spool obtained by integrally resin-molding coil terminals and fixed terminal block obtained by integrally molding fixed terminals, it is possible to prevent occurrence of foreign matters such as cutting scrap occurring when the terminal is press-fitted to a resin molding in a conventional electromagnetic relay, thereby achieving high reliability. Further, it is possible to minimize the thickness of the resin around the terminal, thereby realizing lower mounting height.

Further, the height of the make-side fixed contact is made greater than the height of the break-side fixed contact. In addition, the make-side fixed terminal and break-side fixed terminal formed by bending a metal plate are formed by bending an integrally formed metal plate extending in one plane. With this configuration, parts each serving as base materials of the two fixed terminal can be connected to each other on a hoop, thereby enhancing assembly accuracy and reliability.

Further, the external terminal portion having the leading end portion thereof projecting from the base plate has a bifurcated configuration. This reduces the rigidness of the leading end portion of the terminal, making it easy to perform a terminal bending work for surface mounting and enhancing reliability of soldering connection. Further, with a configuration in which the protective wall under the fixed contacts of the fixed terminal block and another protective wall provided on the base plate surround and cover the winding terminal of the spool, it is possible to prevent diffusion of foreign matters such as soldering or flux residues from the winding terminal to which a coil wire is soldered, thereby enhancing reliability. Further, with a configuration in which the lib formed in the cover is inserted into the lib insertion hole of the base plate for fixation, it is possible to prevent degradation of air-tightness caused by expansion of the top surface of the cover and interfacial peeling between sealant and cover due to reflow heat stress.

As described above, according to the present invention, it is possible to realize a twin-type power electromagnetic relay having higher reliability, having a reduced size and low mounting height, and suitable for surface mounting.

BEST MODE FOR CARRYING OUT THE INVENTION

The present invention will be described with reference to the accompanying drawings.

Figure 1:
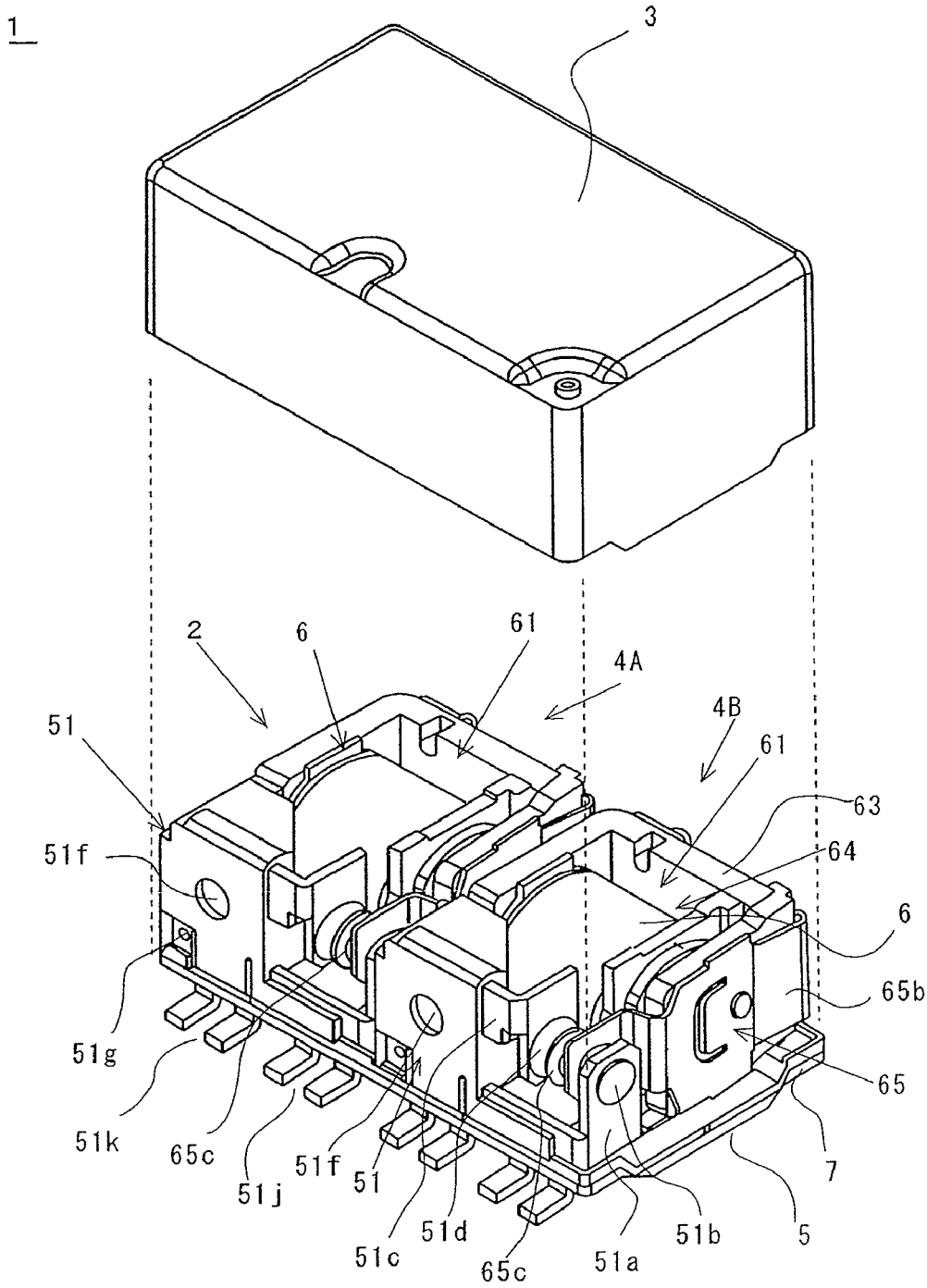
FIG. 1 is a perspective view for explaining an embodiment of an electromagnetic relay according to the present invention, which illustrates an electromagnetic relay body and a cover therefor in a separated manner.

FIG. 1 is a perspective view for explaining an embodiment of an electromagnetic relay according to the present invention, which illustrates an electromagnetic relay body and a cover therefor in a separated manner.

An electromagnetic relay 1 is constituted by an electromagnetic relay body 2 and a cover 3 covering the electromagnetic relay body 2.

The electromagnetic relay body 2 includes two electromagnetic relay blocks 4A and 4B arranged side by side on a base plate 5.

The electromagnetic relay blocks 4A and 4B each have a coil assembly 6 and a fixed terminal block 51. The fixed terminal block 51 has a make-side fixed terminal 51*c* for retaining a make-side fixed contact 51*d* and a break-side fixed terminal 51*a* for retaining a break-side fixed contact 51*b*.

The coil assembly 6 has an electromagnetic block 61, a yoke 63, and a movable terminal block 65. The electromagnetic block 61 has a coli block 64. The coil block 64 has a core attached inside a coil thereof. One end of the core is engaged with the yoke 63.

To the yoke 63, a movable contact spring 65*b* serving as one end of the movable contact block 65 is connected, and the movable contact block 65 has an armature (not illustrated) attracted to the core by magnetic force. Further, the movable terminal block 65 has a movable contact 65*c* at its leading end.

The fixed terminal block 51 is obtained by integrally molding, using a heat resistant resin, the break-side fixed terminal 51*a* for retaining the break-side fixed contact 51*b* and make-side fixed terminal 51*c* for retaining the make-side fixed contact 51*d* having a greater height than the break-side fixed contact 51*b* in terms of the direction projecting toward the movable contact side. The heights of the break-side fixed contact 51*b* and make-side fixed contact 51*d* in the direction projecting toward the movable contact side can be set to about 0.1 mm to 2 mm. A make-side terminal holding portion 51*f* is arranged so as to improve positioning accuracy of the make-side fixed terminal 51*c* at the molding time.

A gate portion 51*g* serving as an inlet used at the time of synthetic resin molding is arranged near the matching face between the base plate 5 and cover. At the time when a sealing material is injected between the cover and base plate 5 so as to seal the inner surface of the cover 3 and a periphery 7 of the base plate 5 to each other with a thermo-setting resin, a sealing material injected into the gate portion 51*g*, thereby preventing foreign matters from occurring from the gate portion formed at the molding time.

The make-side fixed terminal 51*c* and break-side fixed terminal 51*a* each have an external terminal portion for connection to an external wiring. The external terminal portion has substantially a bifurcated configuration. As illustrated in FIG. 1, terminal leading end portions 51*j* and 51*k* of each of the terminal portions project from the base plate 5.

In the electromagnetic relay 1 according to the present invention having the configuration described above, when current is applied to the coil of the coil block 64 constituting the electromagnetic block 61, magnetic force is generated in the coil block 64. Then, the armature 65*a* is attracted to cause the movable contact 65*c* to be moved from the break-side fixed contact 51*b* to make-side fixed contact 51*d* side, whereby the movable contact 65*c* abuts with the make-side fixed contact 51*d*.

When the current application to the coil is stopped, a state before the current application is restored by the action of a movable contact (not illustrated) spring.

Figure 2:
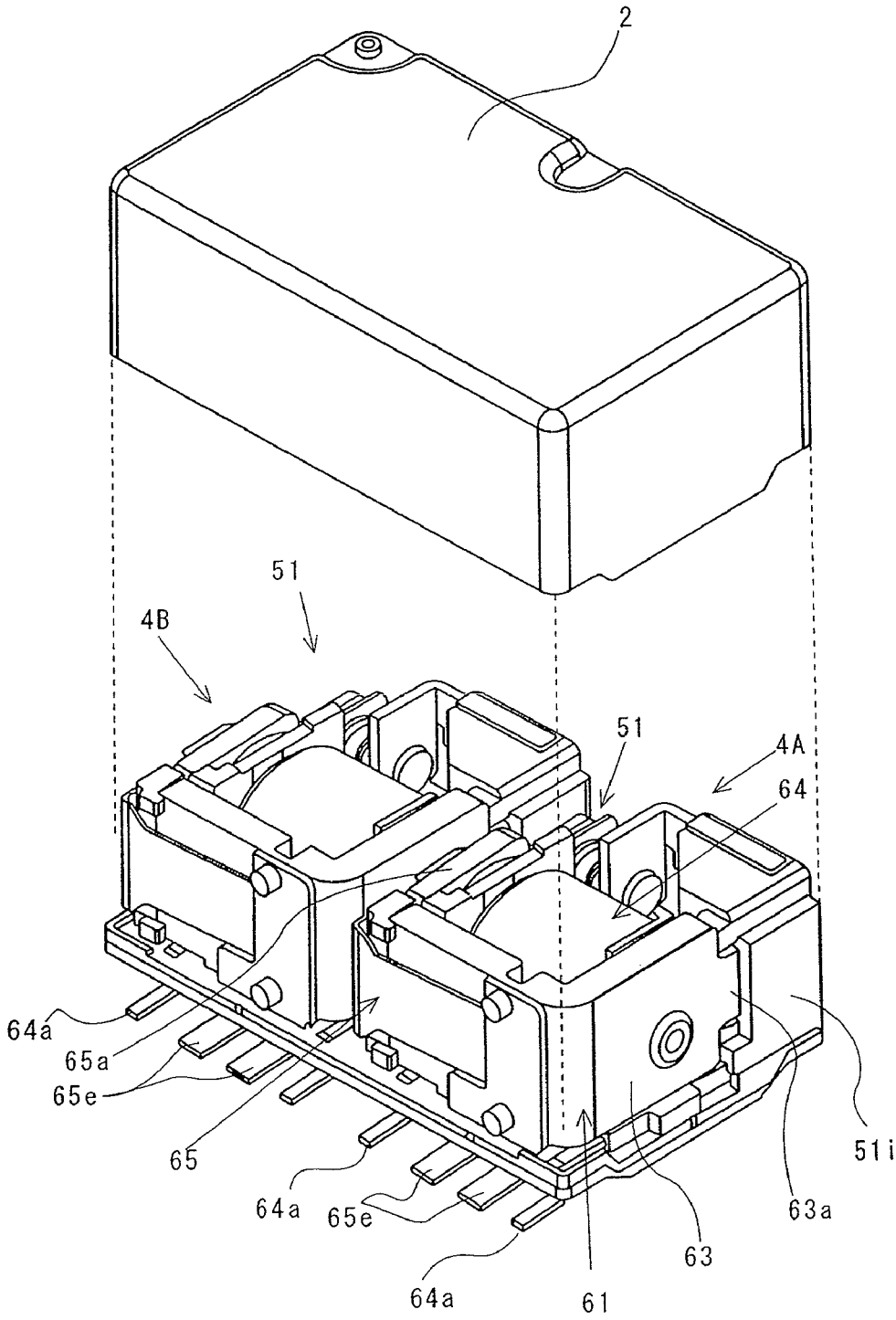
FIG. 2 is a perspective view of the electromagnetic relay of FIG. 1, as viewed from the opposite side to that in FIG. 1.

FIG. 2 is a perspective view for explaining another embodiment of the electromagnetic relay according to the present invention, as viewed from the opposite side to that in FIG. 1.

The two electromagnetic relay blocks 4A and 4B are arranged side by side on the base plate 5 of the electromagnetic relay body 2.

The electromagnetic relay blocks 4A and 4B each have the fixed terminal block 51, electromagnetic block 61, and movable terminal block 65.

The coil block 64 has a core attached inside a coil thereof and has the yoke 63. The yoke 63 has two surfaces crossing each other to form an L-shape. A leading end portion 63*a* of one surface of the yoke 63 is attached to a fixed terminal holding portion 51*i* of the fixed terminal block 51, and the movable contact spring 65*b* is engaged with the other end portion of the one surface of the yoke 63. The yoke 63 further has an engagement hole 63*b* to be engaged with the core through which one end of the core and yoke 63 are engaged with each other.

To the base plate 5, a plate-like coil terminal 64*a*, a movable contact terminal 65*d*, and an external connection terminal 65*e* are firmly fixed.

Figure 3:
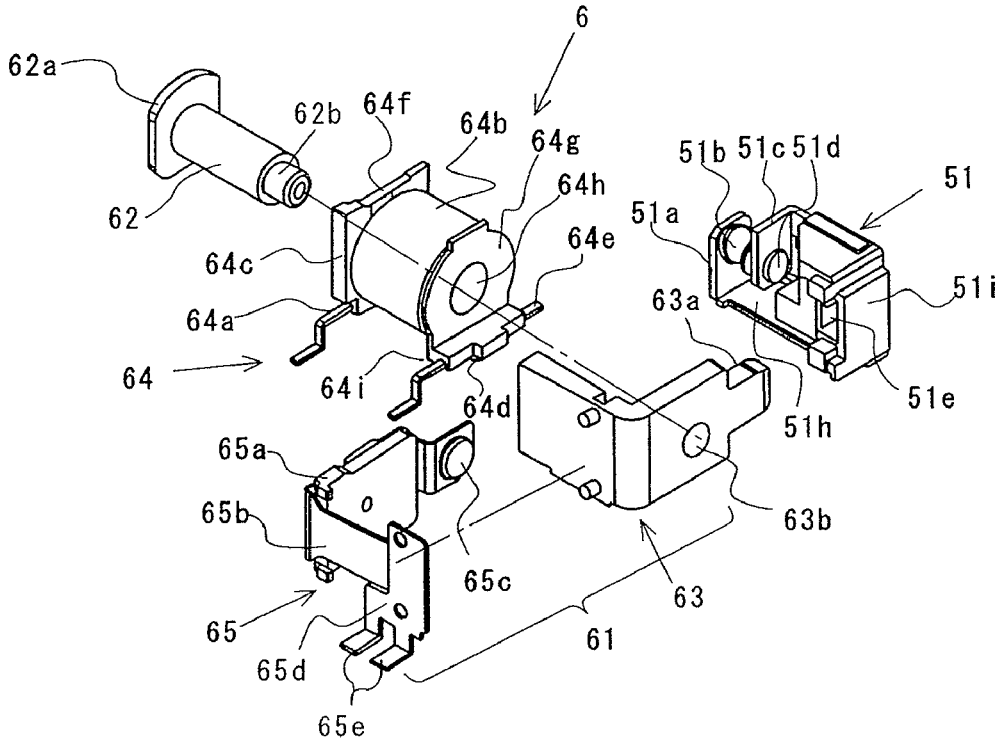
FIG. 3 is an exploded perspective view of an electromagnetic relay body according to the embodiment of the present invention.
Figure 3:
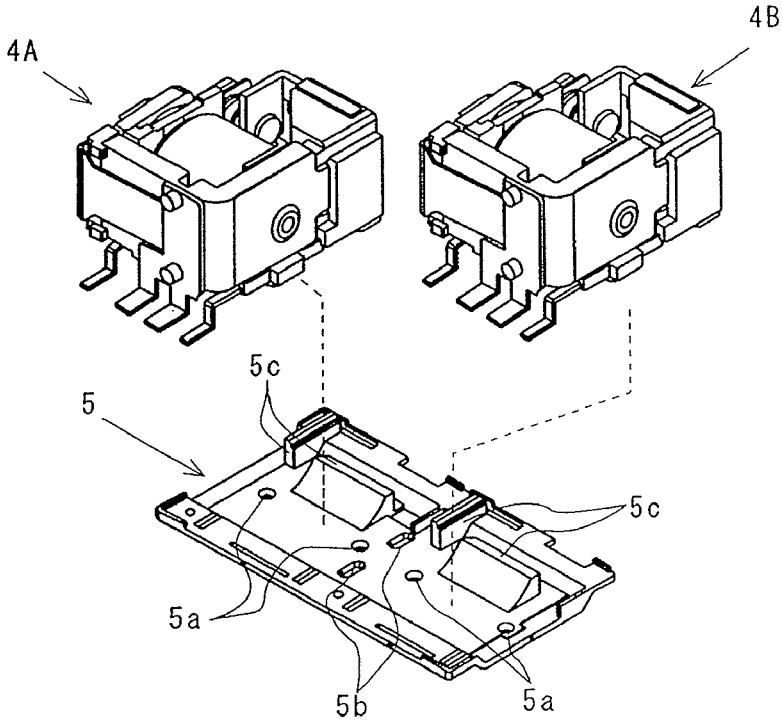

FIG. 3 is an exploded perspective view of the electromagnetic relay body according to the present invention.

The electromagnetic block 61 has the coil assembly 6, which is constituted by the coil block 64, yoke 63, and core 62, and the movable contact block 65.

The coil block 64 has, at its left and right sides, flange portions 64*f* and 64*g* with which the plate-like coil terminals 64*a* and 64*i* are integrally molded respectively using a heat resistant resin. A coil wire 64*b* is wounded around a spool 64*c* having a core hole 64*h* at its center. The coil wire 64*b* is wounded around winding terminal portions 64*e* of a coil terminal 64*a* and 64*i* respectively and soldered.

The yoke 63 is formed into substantially an L-shape such that the two surfaces thereof cross each other at right angle. One surface of the yoke 63 is brought into contact with the flange portion 64*g* of the coil block 64, and the leading end portion of the contact portion is formed into a step-like configuration such that the width becomes narrows. The leading end portion 63*a* is attached to the fixed terminal holding portion 51*i* and 51*e* of the fixed terminal block 51.

A leading end portion 62*b* of the core 62 penetrating the coil block 64 is pushed against the engagement hole 63*b* formed in the yoke 63 so as to enlarge the diameter of the engagement hole 63*b*, whereby the coil block 64 and yoke 63 are caulked-jointed to each other.

Further, a fixed terminal protective wall 51*h* is provided under the break-side fixed contact 51*b* and make-side fixed contact 51*d* constituting the fixed terminal block 51.

The fixed terminal protective wall 51*h* prevents foreign matters such as soldering or flux residues from entering from the terminal around which the coil wire is wounded. The fixed terminal protective wall 51*h* can be formed simultaneously when the fixed terminal holding portion 51*i* is integrally molded using a synthetic resin in the formation of the fixed terminal block 51.

The movable contact block 65 is constituted by the substantially L-shaped movable contact spring 65*b* having two surfaces retaining the movable contact cross each other at right angles, armature 65*a* caulked and fixed to the movable contact spring 65*b*, and movable contact terminal 65*d*. The movable contact spring 65*b* is a high conductive band plate member bent into an L-shape so as to be elastically deformed. The plate-like armature 65*a* attracted by magnetic force is firmly fixed to one surface of the movable contact spring 65*b*, and the movable contact 65*c* is firmly fixed to both surfaces of the leading end portion of the one surface.

The movable contact spring 65*b* is fixed to the surface of the yoke 63 such that the armature 65*a* is positioned on the end surface of an engagement portion 62*a* of the core 62 of the coil block 64. The movable contact terminal 65*d* has the external terminal portion 65*e* for connection to an external wiring, and the external terminal portion 65*e* has substantially a bifurcated configuration. The leading end portion of the external terminal portion projects from the base plate 5 as illustrated in FIG. 2.

Projections 64*d* of the spool 64*c* which is one of the components constituting the electromagnetic relay block 4A are inserted into projection insertion holes 5*a* of the base plate 5 and thermocompressed, whereby the electromagnetic relay block 4A is fixed onto the base plate 5. The electromagnetic relay block 4B is fixed onto the base plate 5 in the same manner. As a result, the two electromagnetic relay blocks 4A and 4B are arranged side by side on the base plate 5 each such that the central axes of the two fixed contacts substantially coincide with each other and the coincident central axis is substantially parallel to the base plate 5.

In the electromagnetic relay described above, a base plate protective wall 5*c* is provided on the base plate 5. The winding terminal portions 64*e* of the spool 64*c* are covered by the base plate protective wall 5*c* and fixed terminal protective wall 51*h* of the fixed terminal block 51 when assembled, thereby preventing foreign matters such as flux from entering between the contacts from the winding terminal portions 64*e*.

In the present invention, a heat resistant resin is used as a molding material, which allows production of an electromagnetic relay excellent in heat resistance. Examples of the heat resistant resin include liquid crystal polymer, phenolic resin, poly ether sulphone, polyphenylene sulfide, polyimide, polyether-ether-ketone (PEEK), polyacetal, polyphenylene ether, polycarbonate, polyamide, polyimide, and polybutylene terephthalate.

Figure 4:
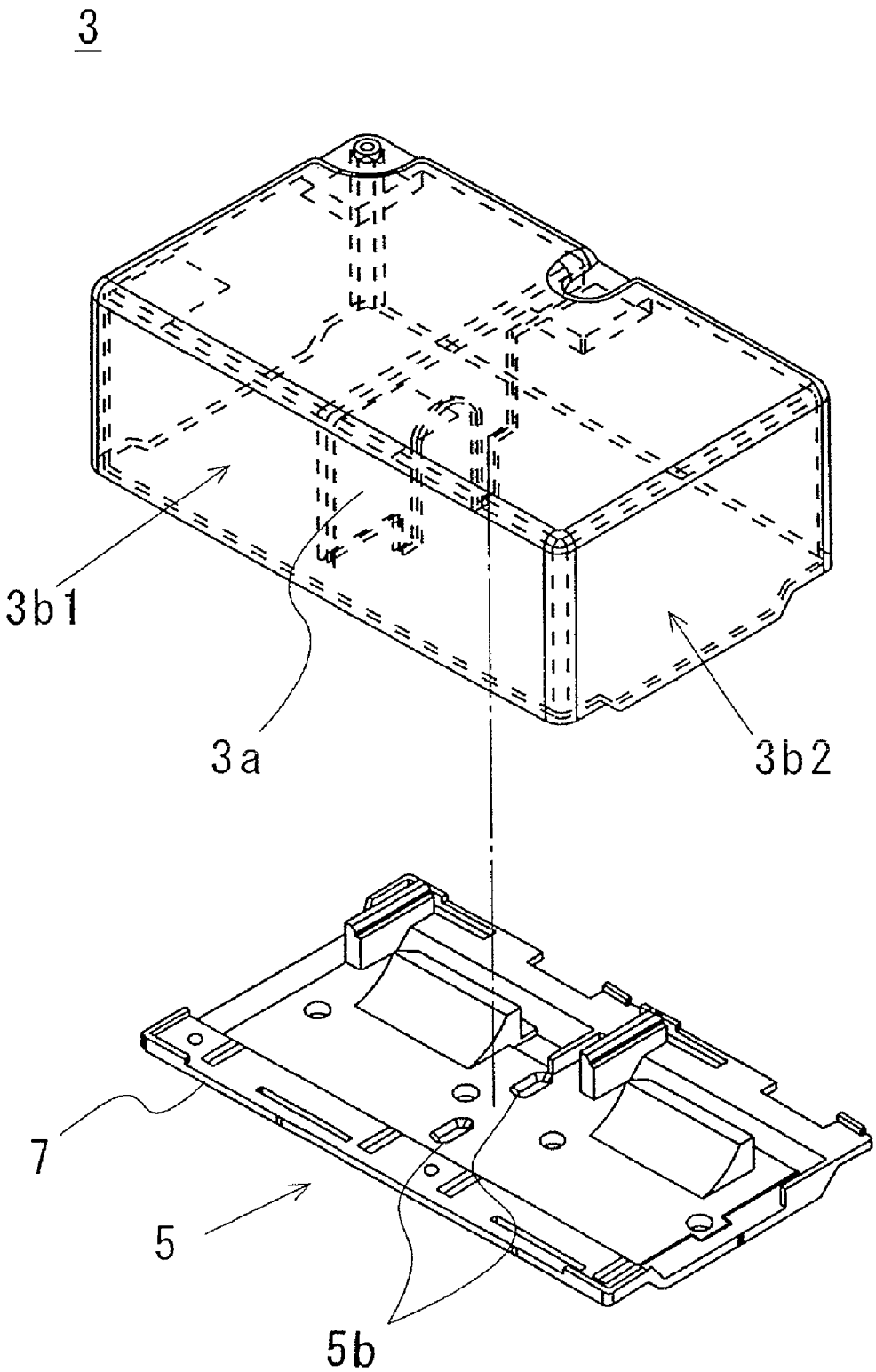
FIG. 4 is a transparent perspective view of a cover of the electromagnetic relay according to the embodiment of the present invention.

FIG. 4 is a view for explaining the cover of the electromagnetic relay according to the present invention.

The cover 3 is a hermetic box-like member having an opening of substantially the same diameter as the base plate 5 so as to be fitted to the base plate 5. The inner surface of the cover 3 and periphery 7 of the base plate 5 are sealed to each other with a thermo-setting resin. A lib 3*a* provided in substantially the center portion of the inner space 3*b*1 and 3*b*2 of the cover 3 divides a space in which the two electromagnetic relay blocks are arranged. The leading ends of the lib 3*a* are inserted into lib insertion holes 5*b* and firmly fixed to the base plate 5 with a thermo-setting resin.

For example, the electromagnetic relay of the present embodiment may be formed into a box shape having one side of a length of 5 mm to 30 mm, and the shapes, dimensions, and materials of respective components constituting the electromagnetic relay may be selected according to a desired outer shape.

As described above, according to the present invention, it is possible to realize a twin-type power electromagnetic relay having higher reliability, having a reduced size and low mounting height, and suitable for surface mounting.

The invention claimed is:

1. An electromagnetic relay having, on a base plate, a plurality of electromagnetic relay blocks each provided with a movable contact swung by excitation current, a normally open contact and a normally closed contact which are arranged opposite to each other in the swinging direction of the movable contact across the movable contact, and fixed contacts, the normally open contact and movable contact being closed by the excitation current and the normally closed contact and movable contact being closed when the application of the excitation current is stopped, wherein the electromagnetic relay blocks each have an electromagnetic block and a fixed terminal block, the electromagnetic block including a coil assembly and a movable contact block, wherein the coil assembly has a coil block in which a coil wire is wounded around a spool having a coil terminal, a yoke formed into substantially an L-shape having one surface extending in the perpendicular direction with respect to the coil winding shaft of the coil block and the other surface extending in parallel thereto, and a core penetrating the coil block and having one end coupled to the yoke, wherein the movable contact block has a movable contact spring having one end coupled to the yoke, an armature coupled to the movable contact spring, and a movable contact terminal having an external terminal portion for connection to an external wiring, wherein the fixed terminal block is obtained by integrally molding, using a synthetic resin, a make-side fixed terminal for retaining a make-side fixed contact constituting the normally open contact and a break-side fixed terminal for retaining a break-side fixed contact constituting the normally closed contact, the fixed terminal block further has a fitting hole to which one end portion of the yoke is fitted, and the make-side fixed terminal and break-side fixed terminal each have an external terminal portion for connection to an external wiring, and wherein at least one projection provided in the spool of the coil assembly constituting each of the electromagnetic relay blocks is inserted into a projection insertion hole formed in the base plate so as to fix each of the electromagnetic relay blocks.

2. The electromagnetic relay according to claim 1, wherein the make-side fixed terminal and break-side fixed terminal are formed by bending a metal plate having a notch, and the make-side fixed terminal and break-side fixed terminal are formed by bending an integrally formed metal plate extending in one plane.

3. The electromagnetic relay according to claim 1, wherein the make-side fixed contact retained by the make-side fixed terminal has a greater height than the break-side fixed contact retained by the break-side fixed terminal in terms of the direction projecting toward the movable contact side.

4. The electromagnetic relay according to claim 1, wherein the external terminal portions of the make-side fixed terminal, break-side fixed terminal and movable contact terminal each have substantially a bifurcated configuration, and leading end portions of each of the external terminal portions project from the base plate.

5. The electromagnetic relay according to claim 1, wherein the coil block has a winding terminal portion around which the coil wire is wound, and the winding terminal portion is surrounded by a protective wall provided under the two fixed contacts of the fixed terminal block and another protective wall provided on the base plate.

6. The electromagnetic relay according to claim 1, wherein the cover has a lib inside thereof, and the leading end portion of the lib is inserted into a lib insertion hole formed in the base plate for fixation.

* * * * *